US006948664B2

(12) United States Patent
Sheedy

(10) Patent No.: US 6,948,664 B2
(45) Date of Patent: Sep. 27, 2005

(54) DRINKING STRAW

(76) Inventor: Paul Daniel Sheedy, 65 Kilmore Road, Artane, Dublin 5 (IE)

( * ) Notice: Subject to any disclaimer, the term of this patent is extended or adjusted under 35 U.S.C. 154(b) by 0 days.

(21) Appl. No.: 10/610,333

(22) Filed: Jun. 30, 2003

(65) Prior Publication Data

US 2004/0069862 A1 Apr. 15, 2004

Related U.S. Application Data

(63) Continuation of application No. 10/148,660, filed as application No. PCT/GB00/04768 on Dec. 13, 2000, now abandoned.

(30) Foreign Application Priority Data

Dec. 14, 1999 (GB) ..... 9929491

(51) Int. Cl.[7] ..... A47G 21/18; A61J 15/00; B05B 12/14; E03B 9/20; A63H 13/00

(52) U.S. Cl. ..... 239/33; 239/24; 446/200; 446/201

(58) Field of Search ..... 239/33, 24; 446/200, 446/201, 202, 217, 218, 71; 73/1.16

(56) References Cited

U.S. PATENT DOCUMENTS

| | | | | | |
|---|---|---|---|---|---|
| 3,315,405 | A | * | 4/1967 | Hoffer | 446/71 |
| 3,332,622 | A | * | 7/1967 | Lombard | 239/33 |
| 3,782,028 | A | * | 1/1974 | Kelly | 446/200 |
| 4,252,273 | A | * | 2/1981 | Karterman | 239/33 |
| 4,579,281 | A | * | 4/1986 | Karterman | 239/33 |
| 6,579,141 | B2 | * | 6/2003 | Bayliss | 446/200 |

* cited by examiner

*Primary Examiner*—David A. Scherbel
*Assistant Examiner*—Darren Gorman
(74) *Attorney, Agent, or Firm*—Anthony R. Barkume, P.C.

(57) ABSTRACT

A drinking straw (1) has a spherical transparent housing (2) formed part way up it in which there is a ball (3) which can be marked or decorated and when a drink is sucked up the straw (1) the ball (3) rotates.

4 Claims, 1 Drawing Sheet

DRINKING STRAW

CROSS-REFERENCE TO OTHER APPLICATION

This application is a continuation application of application Ser. No. 10/148,660, filed May 31, 2002, now abandoned, which is a 371 of PCT/GB00/04768, filed Dec. 13, 2000.

The present invention relates to straw or the like in which there is a device which rotates when liquid is sucked up the straw.

Straws are used for drinking from glasses, containers etc. and, in order to make them more attractive to look at and more fun to use, they can be bent into shapes, loops and coloured etc. The use of such straws can encourage users, particularly if they are children, to drink more.

I have now devised an improved drinking straw.

According to the invention there is provided a drinking straw in which there is a housing, spaced apart from the ends of the drinking straw, with the interior of the housing forming part of the straw and in which housing there is a rotatable device so that, when fluid passes through the straw, the device is rotated by the passage of the fluid.

By the term drinking straw is meant any tubular conduit which can be used for drinking and can be made of any conventionally used material such as waxed paper, a plastics material such as polyethylene, polypropylene, polyvinylchloride a polyterephalate etc. and the straw can be straight curved or any other shape.

The housing is preferably substantially spherical, with the straw offset from the centre of the housing. The housing is preferably substantially transparent so that the rotation of the device can be seen and the device can have a logo, trademark, pattern or design etc. on it which can be seen as it rotates.

Although a substantially spherical shape is preferred for the housing the housing can deviate from the spherical e.g. it can be a flattened sphere or have an ellipsoidal cross section or can be substantially cylindrical with the device inside the housing corresponding in shape to the housing so that it can rotate freely within the housing.

The device preferably fits within the housing with only a small gap between the device and the housing.

In a preferred embodiment of the invention the device is substantially spherical i.e. it is ball shaped, and fits within a substantially spherical housing.

Preferably there is channel formed round the outside of the device in which there are vanes, so that the passage of a fluid impinges on the vanes and makes it easier to rotate the ball.

Although the straw is primarily for use with drinking liquids it can function by blowing or sucking air through it and can be used as a toy or amusement in its own right.

The invention is illustrated in the accompanying drawings in which.

Figure 1:
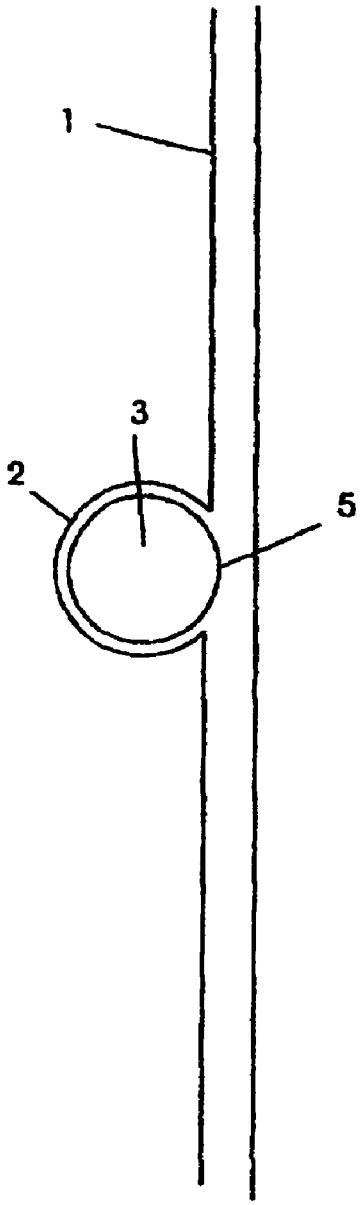
FIG. 1 is a side view of the drinking straw.

Referring to FIG. 1 a drinking straw (1) has a transparent spherical housing (2) formed in it so fluid passing through the straw passes through the housing (2). Within the housing (2) there is spherical ball (3) which is free to rotate within the housing.

Figure 2:
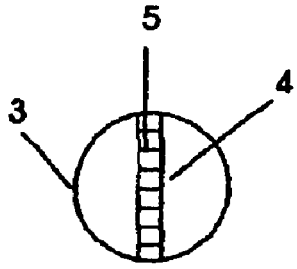
FIG. 2 is plan view of the ball

Referring to FIG. 2 the ball (3) has a channel (4) formed around a circumference in which there are vanes (5). The ball is positioned in the housing so that fluid passing through the straw will impinge on the vanes.

In use fluid e.g. a drink, is sucked up the straw and impinges on the vanes (5) of the ball (3) and causes the ball to rotate and the ball and its rotation is visible from outside the housing.

In use a range of visual effects can be achieved by colouring or patterning the ball or having a logo or words etc. on the ball.

What is claimed is:

1. A drinking straw having first and second ends and further comprising:

a housing of substantially transparent material located in and spaced apart from the ends of the straw with the interior of the housing forming part of the straw; and a single spherical ball rotor within the housing, said spherical ball rotor having a spherical surface and comprising:

a channel extending around a circumference of said spherical ball rotor and embedded within the surface of the spherical ball rotor, and a plurality of vanes disposed within said channel and arranged such that fluid passing through the straw will impinge on the vanes and cause the rotor to rotate with respect to the housing.

2. The straw of claim 1, wherein said first end of said straw and said second end of said straw are substantially axially aligned along a first axis and said rotor is arranged to rotate about an axis which is substantially perpendicular to said first axis.

3. The straw of claim 1, wherein said housing has a center and said straw is offset from said center of said housing.

4. The straw of claim 1, wherein the rotor fits within the housing with only a small gap between said rotor and said housing and corresponds in shape to the housing so that it can rotate freely in said housing.

* * * * *